United States Patent [19]

Caputo et al.

[11] 4,085,823

[45] Apr. 25, 1978

[54] ELEVATOR SYSTEM

[75] Inventors: William R. Caputo, Wyckoff; John J. De Lorenzi, Manalapan, both of N.J.

[73] Assignee: Westinghouse Electric Corporation, Pittsburgh, Pa.

[21] Appl. No.: 628,448

[22] Filed: Nov. 3, 1975

[51] Int. Cl.[2] ..... B66B 5/02

[52] U.S. Cl. ..... 187/29 R

[58] Field of Search ..... 187/29

[56] References Cited

U.S. PATENT DOCUMENTS

| | | | |
|---|---|---|---|
| 3,584,706 | 6/1971 | Hall et al. | 187/29 |
| 3,741,348 | 6/1973 | Caputo | 187/29 |
| 3,785,463 | 1/1974 | Kuhl et al. | 187/29 |
| 3,961,688 | 6/1976 | Maynard | 187/29 |

*Primary Examiner*—Robert K. Schaefer
*Assistant Examiner*—W. E. Duncanson, Jr.
*Attorney, Agent, or Firm*—D. R. Lackey

[57] ABSTRACT

An elevator system including an elevator car and counterweight mounted for movement in a structure by a traction drive arrangement which includes a drive sheave and a drive motor. A first tachometer provides signals responsive to the drive motor and a second tachometer provides signals responsive to movement of the elevator car. The signals from the first and second tachometers are used in both functional and monitoring circuits to control the operation of the elevator system in a highly efficient self-checking manner.

31 Claims, 8 Drawing Figures

+15V
160
3-1
164
166
168
-15V
162
170
172
A-1
VT1
VT2
T
174
A.V.
AMP.
RZ2
RZ1
202
Z1
|VT1+T - VT2|
|VT1+T-AG|
212
A.V.
AMP.
214
Z2
AG
210
AMPLIFIER
G1(S)
VSP

3
A
T
Z1
Z2
P
D
(+)
O
(-)
180
182
184
186
188
190
192
194
196
200
TIME

ELEVATOR SYSTEM

BACKGROUND OF THE INVENTION

1. Field of the Invention

The invention relates in general to elevator systems, and more specifically to elevator systems of the traction type.

2. Description of the Prior Art

Elevator systems of the traction type which operate at speeds above about 500 feet per minute require a car speed feedback signal to determine the deviation of actual car speed from the desired car speed, and to use the deviation to take the corrective action necessary to closely regulate the car speed to the desired speed pattern. Signals are also provided when the elevator car passes certain relatively low speed values as it accelerates and decelerates, in order to determine when certain control functions should be performed, as well as to monitor the operation of the elevator car at predetermined points, such as during slow down and leveling. A car speed checking arrangement is disposed adjacent each travel limit of the elevator car, in order to determine if the car is slowing down within prescribed limits, and if it is not, to provide auxiliary terminal slow down means. The speed control for the elevator car is stabilized with a stabilizing feedback signal related to the rate of change of car speed. The stabilizing signal should not introduce low frequency electrical noise into the control signal to which the car is capable of responding.

These car speed related signals should be generated as accurately as possible, and with as little electrical noise in the signals as possible, in order to reduce stability problems. Further, in order to reduce system cost without sacrificing reliability the signals should be generated by low cost apparatus in a self-checking, fail-safe manner.

In the prior art, it is common to utilize a tachometer belted to the drive motor for developing the car speed feedback signal. The belt, gear teeth and eccentric gears, as well as the slots, commutator bars and brushes used in the construction of the tachometer, all add electrical noise to the velocity signal, but it is a reliable arrangement and broken belt switches make it safe.

The car speed indicating signals which indicate whether or not the elevator car is above or below predetermined relatively low speeds may be generated by speed switches operated in accordance with the speed of the drive motor, such as the magnetically coupled car speed responsive sensor disclosed in U.S. Pat. No. 3,802,274, which is assigned to the same assignee as the present application. These sensors are belt driven from the elevator drive motor, and while the speed points are sometimes difficult to set, and there is hysteresis between the operating points of the switches during acceleration and deceleration, the switches are rugged and reliable and safe because of broken belt switches.

The car speed checking arrangement adjacent the terminals or travel limits of the elevator car may monitor the floor selector, and if the floor selector is not operating in a manner which will produce a normal slow down, an auxiliary speed pattern is produced for controlling terminal slow down. In one prior art arrangement with an electromechanical floor selector a long cam disposed adjacent each terminal opens a series of switches mounted on the elevator car, one after another, and if the floor selector is operating properly, for each cam operated switch opening in the hoistway there should be a switch closing on the floor selector carriage. If this fails to occur, the auxiliary speed pattern is provided. U.S. Pat. No. 3,779,346, which is assigned to the same assignee as the present application, develops a terminal slow down arrangement which may be used with a solid state form of floor selector wherein spaced teeth adjacent each terminal cooperate with a sensor disposed on the car to detect overspeed and to automatically provide the correct slow down pattern if necessary. This arrangement operates with a low inertia, fast acting car speed sensor switch as a backup, such as the speed sensor disclosed in U.S. Pat. No. 3,814,216, which is assigned to the same assignee as the present application.

The stabilization signal may be obtained by taking the derivative of the drive motor armature voltage, or the derivative of the counter e.m.f. developed by the armature of the drive motor, when a direct metallic connection to the motor armature circuit can be tolerated. When a direct connection is not practical, such as in an elevator drive system with a solid state source of electrical potential for the drive motor, instead of a rotating source, the magnetically coupled acceleration transducer disclosed in U.S. Pat. No. 3,749,204, which is assigned to the same assignee as the present application, may be used. This arrangement provides a stabilizing signal responsive to the rate of change of the motor counter e.m.f.

Thus, in a single elevator system, many different types of apparatus may be used to generate the various speed responsive signals necessary in order to efficiently and safely control the operation of an elevator car. It would be desirable to reduce the amount and cost of the apparatus required to generate these speed related signals, if such reduction of apparatus and cost can be accomplished while maintaining the reliability and fail-safe characteristics of the prior art system arrangements.

SUMMARY OF THE INVENTION

Briefly, the present invention is a new and improved elevator system which provides the required speed related signals in a new and improved manner which not only simplifies the generation of such signals but which utilizes the signals to control and monitor the system in a self-checking, fail-safe manner.

The new and improved elevator system utilizes a rim driven low ripple tachometer responsive to the speed of the drive motor. The rim or friction drive does not have the electrical noise associated therewith that a belt driven tachometer does, permitting the stabilizing signal to be obtained by taking the derivative of the tachometer signal. The derivative of the tachometer signal is a better stabilizing signal than the rate of change of counter e.m.f., since counter e.m.f. for a given speed varies with field flux.

The new and improved elevator system also uses a belt driven tachometer responsive to car speed, which tachometer may have a higher ripple than the first tachometer, since the belt drive destroys any advantage of a low noise tachometer, but it provides a safe backup due to the use of broken belt switches.

The output signals of the two tachometers are compared in a monitoring circuit which detects any slippage of the rim driven tachometer, the failure of a tachometer, as well as detecting any slippage between the hoist ropes and drive sheave, since the rim driven tachometer is responsive to the drive motor speed, and the belt driven tachometer is responsive to car speed. The output signals of the two tachometers are scaled and compared with reference signals to develop speed points which are generated alternately by the two tachometers. A monitoring circuit monitors the upward and downward progression of speed points, insuring that they occur in the proper sequence. The speed points are compared with car position adjacent to each terminal to determine if an auxiliary terminal slow down pattern should be used, or if an emergency stop should be made.

The output of the rim driven tachometer is also compared with a signal representative of the expected dynamic response of the elevator system, thus detecting any loss of control before the elevator car reaches a speed which would trip the governor.

The monitoring circuit, upon detecting any malfunction while the car is operating, reduces the car speed and stops the car at the closest floor at which it can stop without exceeding normal deceleration limits. If the car is already stopped when a malfunction is detected, the car will not be permitted to start. The subsequent disappearance of certain types of malfunctions enables the elevator car to again be operated, but if another malfunction occurs within a predetermined period of time, the elevator car will not be restarted upon disappearance of the malfunction, and maintenance personnel will be required to restart the system.

BRIEF DESCRIPTION OF THE DRAWING

The invention may be better understood, and further advantages and uses thereof more readily apparent, when considered in view of the following detailed description of exemplary embodiments, taken with the accompanying drawings, in which.

DESCRIPTION OF PREFERRED EMBODIMENTS

Figure 1:
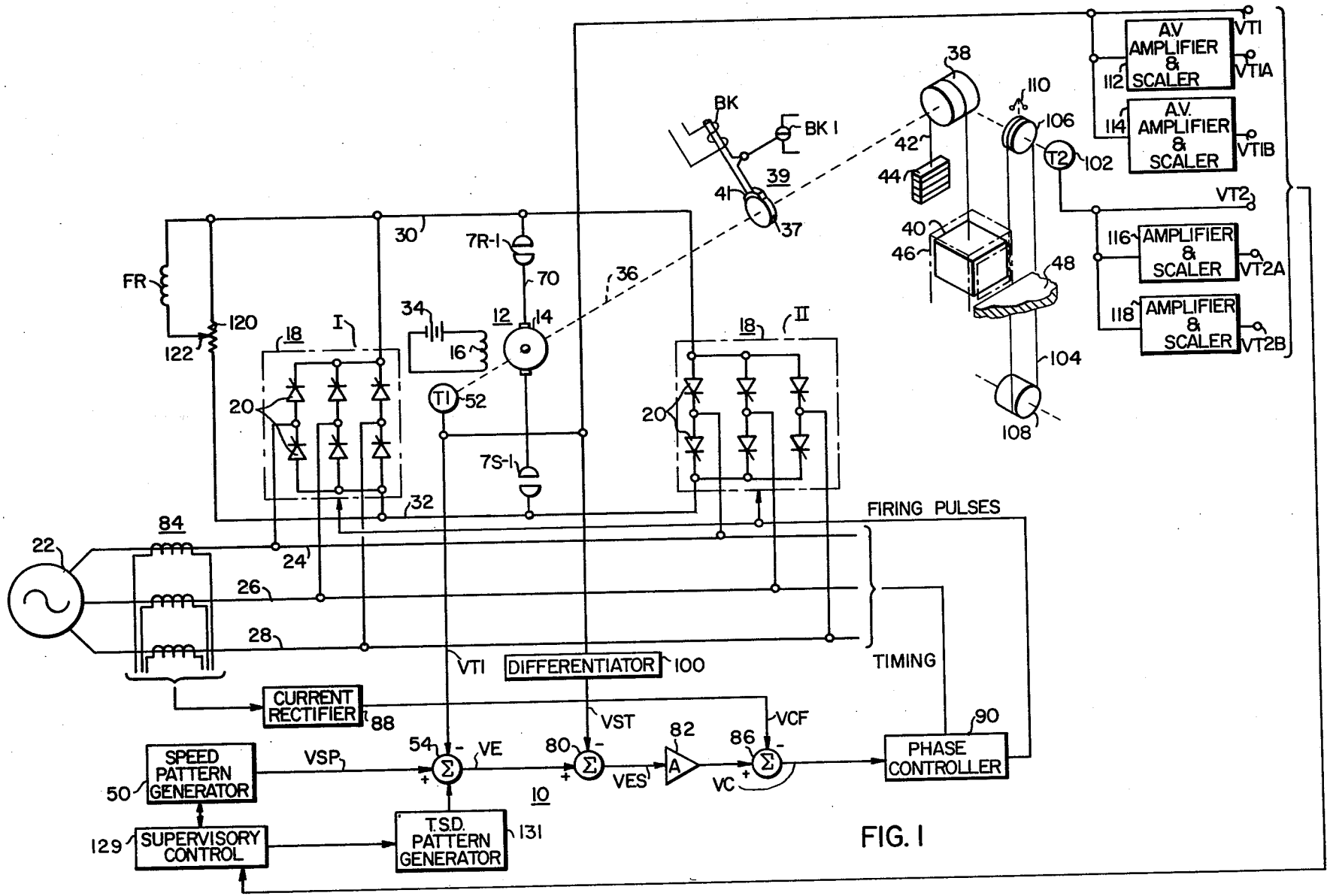
FIG. 1 is a schematic diagram of an elevator system constructed according to the teachings of the invention.

As an aid to understanding the drawings, the relays and switches are identified as follows:

A — Brake Monitor Relay
BK — Brake Solenoid Coil
DL — Down Travel Limit Switch
FR — Relay which picks up as the elevator nears contract speed
OS — Overspeed Switch
SS — Stepping Switch
Sl - S(N) — Speed Indicating Relays
S30 — 30 F.P.M. Speed Indicating Relay
S150 — 150 F.P.M. Speed Indicating Relay
UL — Up Travel Limit Switch
W — Pattern Selector Relay
X — System Monitoring Relay
Z1 — Tachometer Comparison Relay
Z2 — Actual Versus Expected System Response Relay
1 — Up Direction Relay
2 — Down Direction Relay
3 — Running Relay
7R — Line Contactor
7S — Line Contactor
29 — Safety Circuit Relay
60P — Relay which is deenergized momentarily during initial start-up Referring now to the drawings, and FIG. 1 in particular, there is shown an elevator system 10 which includes a direct current drive motor 12 having an armature 14 and a field winding 16. The armature 14 is electrically connected, via contacts 7R-1 and 7S-1 of suitable line contactors, to an adjustable source of direct current potential. The source of potential may be a direct current generator of a motor generator set in which the field of the generator is controlled to provide the desired magnitude of unidirectional potential; or, as shown in FIG. 1, the source of direct current potential may be a static source, such as a dual converter 18. The dual converter is selected as the adjustable source of direct current in this example, because the dual converter presents certain problems solved by the invention, ie., the stabilizing signal of the invention does not directly contact the armature circuit of the drive motor, but it is to be understood the invention may equally apply to elevator systems which use a motor generator set as the source of direct current potential.

The dual converter 18 includes first and second converter banks I and II, respectively, which may be three-phase, full-wave bridge rectifiers connected in parallel opposition. Each converter includes a plurality of controlled rectifier devices 20 connected to interchange electrical power between alternating and direct current circuits. The alternating current circuit includes a source 22 of alternating potential and busses 24, 26 and 28, and the direct current circuit includes busses 30 and 32, to which the armature 14 of the direct current motor 12 is connected. The dual bridge converter 18 not only enables the magnitude of the direct current voltage applied to armature 14 to be adjusted, by controlling the conduction or firing angle of the controlled rectifier devices, but it allows the direction of the direct current flow through the armature 14 to be reversed when desired, by selectively operating the converter banks. As illustrated, when converter bank I is operational, current flow in the armature 14 would be from bus 30 to bus 32, and when converter bank II is operational, the current flow would be from bus 32 to bus 30.

The field winding 16 of drive motor 14 is connected to a source 34 of direct current voltage, represented by a battery in FIG. 1, but any suitable source, such as a single bridge converter, may be used.

The drive motor 12 includes a drive shaft indicated generally by broken line 36, to which a brake drum 37 and a traction sheave 38 are secured. An elevator car 40 is supported by a rope 42 which is reeved over the traction sheave 38, with the other end of the rope being connected to a counterweight 44. The elevator car is disposed in a hoistway 46 of a structure having a plurality of floors or landings, such as floor 48, which are served by the elevator car. The brake drum 37 is part of a brake system 39 which includes a brake shoe 41 which is spring applied to the drum 37 to hold the traction or drive sheave 38 stationary, and is released in response to energization of a brake coil BK. When the brake is applied, a contact BK-1 is closed, and when the brake is picked up, contact BK-1 is open.

The movement mode of the elevator car 40 and its position in the hoistway 46 are controlled by the voltage magnitude applied to the armature 14 of the drive motor 12. The magnitude of the direct current voltage applied to armature 14 is responsive to a velocity command signal VSP provided by a suitable speed pattern generator 50. The servo control loop for controlling the speed, and thus the position of car 40 in response to the velocity command signal VSP may be of any suitable arrangement, with a typical control loop being shown schematically in FIG. 1.

A single VT1 responsive to the actual speed of the elevator drive motor 12 is provided by a first tachometer 52. A comparator 54 provides an error signal VE responsive to any difference between the velocity command signal VSP and the actual speed of the motor 12, represented by signal VT1.

Tachometer 52 is coupled to the shaft 36 of the drive motor 12 via a rim drive arrangement, ie., the tachometer 52 has a roller secured to its drive shaft which contacts and is frictionally driven by the circumferential surface of the motor drive shaft, or a suitable member which rotates with the motor drive shaft 36 of the drive motor 12. Since the tachometer 52 is coupled to the drive motor with a rim drive arrangement, a tachometer having a relatively low ripple such as 2% peak-to-peak, may be used, as its high quality output signal will not be degraded by electrical noise such as would be generated by a belt drive arrangement. For example, a Magnedyne 402-52 tachometer may be used. A disadvantage of the rim drive is possible slippage, but as will be hereinafter described, self-checking circuits will detect such slippage, as well as tachometer failure.

Since a tachometer having a relatively low ripple may be used, which tachometer when rim driven has a minimum of electrical noise in its output signal, a superior stabilizing signal for achieving smooth system response may be obtained by taking the derivative of the tachometer output signal VT1. Accordingly, a differentiation circuit 100 is provided for differentiating signal VT1 and providing a stabilizing signal VST. The stabilizing voltage VST is applied as a negative feedback signal to the closed control loop, stabilizing the signal VE. Signals VE and VST are applied to a summing circuit 80 with the algebraic signs illustrated in FIG. 1, in order to provide a stabilized error signal VES. The stabilized error signal VES may be amplified in an amplifier 82, and depending upon the specific control loop utilized, the amplified signal may be compared with a signal VCF in a comparator 86, with signal VCF being responsive to the current supplied to the dual converter 18. Signal VCF may be provided by any suitable feedback means, such as by a current transformer arrangement 84 disposed to provide a signal responsive to the magnitude of the alternating current supplied by the source 22 to the converter 18 via busses 24, 26 and 28, and a current rectifier 88 which converts the output of the current transformer arrangement 84 to a direct current signal VCF. As disclosed in U.S. Pat. No. 3,713,012, which is assigned to the same assignee as the present application, amplifier 82 may be a switching amplifier which is responsive to the polarity of the input signal to enable the unidirectional signal VCF to be used regardless of the polarity of the input signal VES.

Signal VCF and the amplified signal VES are compared in a comparator 86 to provide a signal VC responsive to any difference, which signal is applied to a phase controller 90. Phase controller 90, in response to timing signals from busses 24, 26 and 28 and the signal VC, provide phase controlled firing pulses for the controlled rectifier devices of the operational converter bank. The hereinbefore mentioned U.S. Pat. No. 3,713,012 discloses a phase controller which may be used for the phase controller 90 shown in FIG. 1.

A second tachometer 102 is provided which is responsive to the speed of the elevator car 40. The second tachometer 102 provides a check on the rim driven tachometer 52, and it may be a less costly tachometer than tachometer 52, ie., it may have a higher ripple compared with that of tachometer 52, since its output will not be differentiated to provide a stabilizing signal. The second tachometer 102 may be driven from the governor assembly which includes a governor rope 104 connected to the elevator car 40, reeved over a governor sheave 106 at the top of the hoistway 46, and reeved over a pulley 108 located at the bottom of the hoistway. A governor 110 is driven by the shaft of the governor sheave, and the tachometer 102 may also be driven by the shaft of the governor sheave 106, such as via a belt drive arrangement. The belt drive is fail-safe with broken belt switches, and since the signal from tachometer 102 will not be differentiated, the electrical noise added to the signal by the belt drive is not of critical importance.

The velocity signal VT1 provided by tachometer 52, which signal is responsive to the speed of the elevator drive motor 12, is processed and scaled in an absolute value amplifier 112. The output of amplifier and scaler 112 is a unipolarity signal VT1A proportional to the magnitude of the velocity signal VT1, with the scaling of 10 volts per 450 feet per minute. In like manner, the velocity signal VT2 provided by tachometer 102, which signal is responsive to the speed of the elevator car 40, is processed and scaled in an absolute value amplifier 116. The output of amplifier and scaler 116 is a unipolarity signal VT2A, proportional to the magnitude of the velocity signal VT2, with a scaling of 10 volts per 450 feet per minute. The scaled signals VT1A and VT2A are used to develop control signals which indicate whether the elevator car is traveling below or above specific speeds. For elevator systems rated 500 feet per minute contract speed, signals VT1A and VT2A are also used as speed check points which initiate terminal slow down or cause the car to make an emergency stop, when the elevator speed exceeds predetermined values at predetermined car positions relative to a travel limit or terminal.

For elevator systems which exceed 500 feet per minute contract speed, signals VT1 and VT2 are processed and scaled in additional absolute value amplifiers 114 and 118, respectively, to provide signals VT1B and VT2B, respectively, with a scaling of 10 volts per 1800 feet per minute. The use of the scaled signals VT1A, VT1B, VT2A and VT2B will be hereinafter described in detail.

A relay FR is connected to be responsive to the voltage applied to the armature 14 of the drive motor 12, such as by connecting an adjustable resistor 120 between busses 30 and 32, and connecting the electromagnetic coil of relay FR from bus 30 to the adjustable arm 122 of resistor 120. The arm 122 is adjusted such that relay FR will pick up when the voltage across the armature 14 indicates that the maximum rated speed of the elevator car is about to be reached.

Supervisory control 129 is provided, specific circuits thereof which will be hereinafter described in detail, for processing the signals VT1, VT1A, VT1B, VT2, VT2A and VT2B, to provide indications that certain speed check points have been exceeded, to compare the signals in a manner which provides a continuous check on the performance of the elevator system, to activate a terminal slow down pattern generator 131 when the normal slow down speed for a terminal floor is exceeded, and to otherwise modify the operation of the elevator system 10 when the supervisory or monitoring circuits of control 129 indicate the system is not operating properly.

Figure 2:
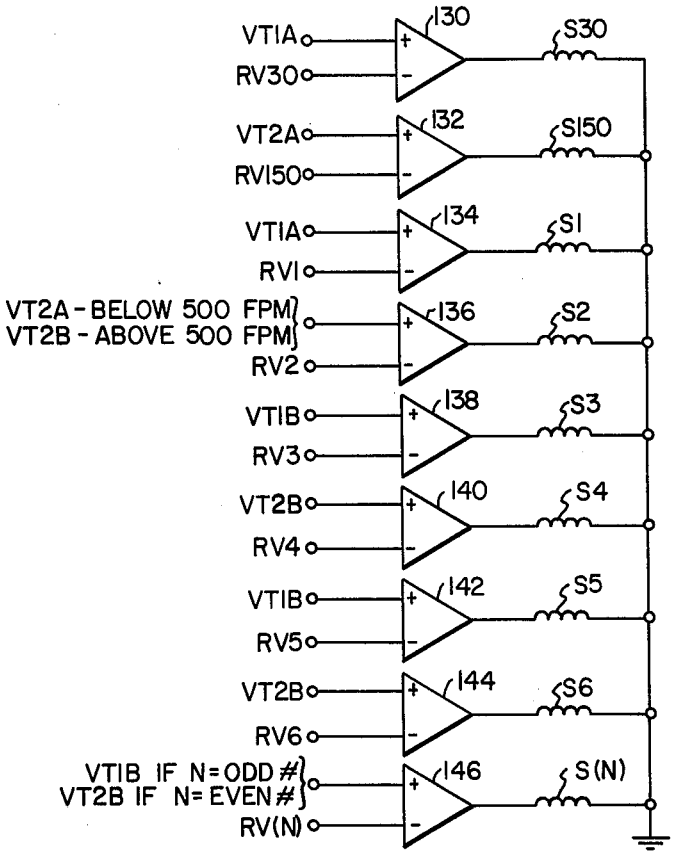
FIG. 2 is a schematic diagram which illustrates the generation of a plurality of speed check points according to the teachings of the invention.
Figure 3:
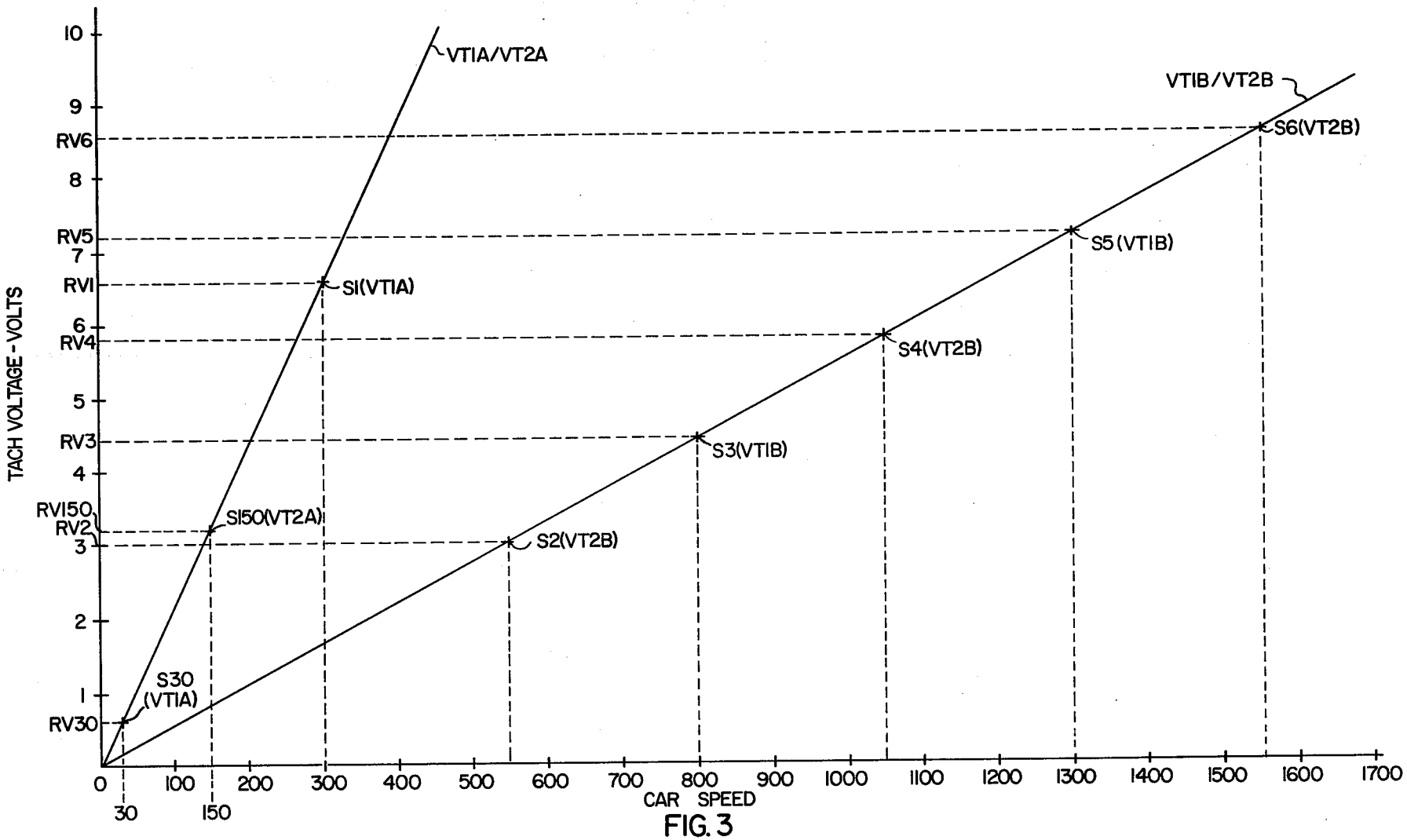
FIG. 3 is a graph which illustrates the operation of the circuit shown in FIG. 2.

FIG. 2 is a schematic diagram of a portion of control 129 shown in FIG. 1, for developing signals which indicate when the elevator car 40 exceeds specific speeds. The specific number of speed check points is dependent on the contract speed of the elevator car. As a continuous check on the tachometers 52 and 102, the speed check points are generated alternately from the two tachometers, and circuits to be hereinafter described check to insure that the speed check point relays pick up and drop out in the proper sequence. FIG. 3 is a graph in which car speed is plotted on the abscissa or X axis, and tachometer voltage is plotted on the ordinate or Y axis, illustrating the generation of the speed check points.

The 30 fpm and 150 fpm speed check points used during slow down and leveling at each floor are generated from signals VT1A and VT2A, respectively. For example, as the elevator car approaches a floor at which it is to stop, door pre-opening may be delayed until the car speed drops below 150 fpm, to insure that the car is within thelanding zone, and a predetermined period of time later the car should be near floor level and its speed should be below 30 fpm. If the car speed is above 30 fpm at this time, an emergency stop is initiated. The 150 fpm speed indicator may also be used when the elevator car is on hand operation, causing the car to make an emergency stop if the car speed exceeds 150 fpm while on hand control.

The 30 fpm speed indication may be generated by a comparator 130, such as an operational amplifier having noninverting and inverting inputs, and an electromagnetic relay S30, which operates only for a positive potential at the comparator output. The coil of relay S30 is connected between the output of the comparator 130 and ground. A positive reference voltage RV30 is connected to the inverting input, and the scaled unipolarity velocity signal VT1A from tachometer 52 is connected to the non-inverting input. The reference voltage RV30 will have a magnitude of 30/450 × 10 volts or 0.67 volts, since the scaling of the signal VT1A is 10 volts for 450 feet per minute. When reference signal RV30 exceeds the magnitude of signal VT1A, the output of comparator 130 will be negative and relay S30 will deenergized. When the car speed exceeds 30 fpm and signal VT1A exceeds 0.67 volts, the output of comparator 130 will switch positive, energizing relay S30. Thus, relay S30 provides an indication when the specific speed check point 30 fpm has been exceeded. In like manner, a comparator 132 and a relay S150 provide the 150 fpm speed indication, using the scaled unipolarity velocity signal VT2A from tachometer 102 and a reference voltage RV150. The reference voltage RV150 will have a positive magnitude of 150/450 × 10, or 3.33 volts.

Speed check points for monitoring terminal slow down and initiating the switch to the auxiliary terminal slow down pattern, or for initiating an emergency stop, are provided by relays S1 through S(N), with N depending upon the contract speed of the elevator. For example, a speed check point may be provided for 300 feet per minute by relay S1 using a comparator 134, signal VT1A from the tachometer 52, and a positive reference voltage RV1 having a magnitude of 300/450 × 10, or 6.67 volts. The next speed check point, which is provided by relay S2 and a comparator 136, will be below 500 fpm if the elevator contract speed is 500 fpm, and it will be above 500 fpm for higher contract speeds. If the speed check point is below 500 fpm, the signal VT2A from tachometer 102 will be used, and if it is above 500 fpm signal VT2B from tachometer 102 will be used. For purposes of example, it will be assumed that the speed check point is 550 fpm, which will thus compare signal VT2B with a positive reference voltage RV2 having a magnitude of 550/1800 × 10 or about 3 volts, since signal VT2B is scaled 10 volts for 1800 fpm.

In like manner, relay S3, comparator 138, signal VT1B of tachometer 52 and reference voltage RV3 cooperate to provide a speed check point at 800 fpm. Relay S4, comparator 140, signal VT2B of tachometer 102 and reference voltage RV4 cooperate to provide a speed check point at 1050 fpm. Relay S5, comparator 142, signal VT1B of tachometer 52, and reference voltage RV5 cooperate to provide a speed check point at 1300 fpm. Relay S6, comparator 144, signal VT2B of tachometer 102, and reference voltage RV6 cooperate to provide a speed check point at 1550 fpm. If additional check points are required, the last check point will be provided by relay S(N), comparator 146, signal VT1B if N is odd and signal VT2B if N is even, and a reference voltage RV(N).

Figure 4:
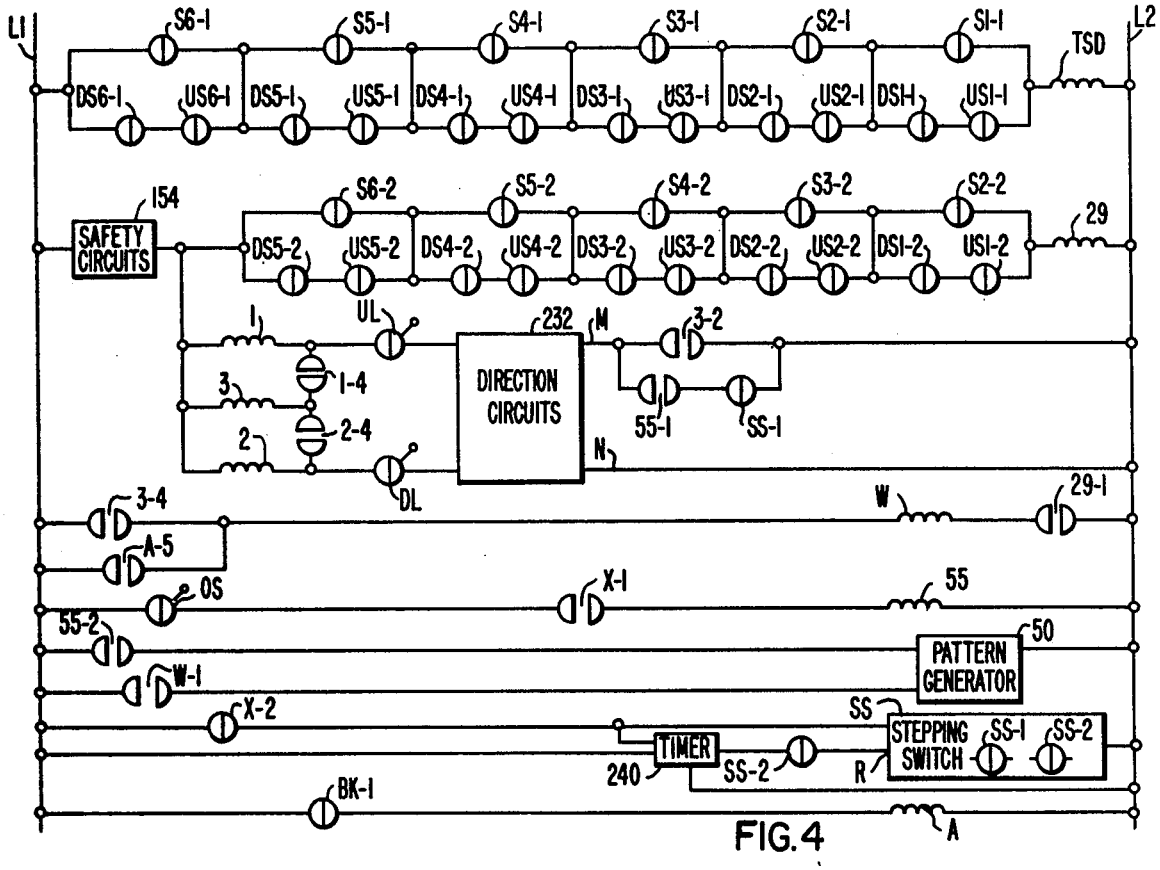
FIG. 4 is a schematic diagram illustrating the auxiliary terminal slow down and emergency stop detecting circuits, as well as the circuitry for modifying the operation of the elevator car in response to a circuit malfunction.

FIG. 4 is a schematic diagram which illustrates a portion of control 129 which utilizes the speed check point indications of FIG. 2 to initiate the transfer to the auxiliary terminal slow down pattern provided by the terminal slow down pattern generator 131 illustrated in FIG. 1, or to initiate an emergency stop. A normal slow down pattern is provided by speed pattern generator 50. The speed pattern generator 50 may be provided by an electromechanical floor selector having synchronous and advance carriages. When the elevator car is to stop at a floor the advance carriage stops at the location of the floor selector corresponding to that floor, and as the synchronous carriage continues to move responsive to car movement it moves an iron core into a solenoid coil on the advance carriage to smoothly increase the impedance of the solenoid and to reduce the magnitude of the speed pattern. Another example of the speed pattern generator is disclosed in U.S. Pat. No. 3,554,325, which is assigned to the same assignee as the present application. This speed pattern generator includes a helical carriage having floor stops distributed along its periphery at points corresponding to the landings in the hatchway. The helical carriage is rotated in synchronism with the car and as it does so it advances axially under a control head which corresponds to the car. The control head is connected to a transducer which is preferably a potentiometer. The output voltage of the potentiometer represents the desired speed of the car. As the car is started from a landing, a clutch is engaged which rotates the control head in a direction opposite to the direction of rotation of the helical carriage. The resultant displacement of the control head with respect to the floor stops represents the advanced car position while the displacement of the potentiometer from the neutral position represents the desired speed. When the control head reaches the fully advanced position the clutch is released and the desired maximum speed is attained. When the car is to be stopped, solenoids on the control head holding pawls in their retracted position are deenergized so that the pawls are extended where they may be engaged by the floor stops. With the control head thus connected to the rotating helix, it is urged toward the neutral position thereby reducing the output voltage of the potentiometer and thus bringing the car to a smooth stop at the landing. For purposes of example, it will be assumed that the speed pattern generator 50 shown in FIGS. 1 and 4 is of this latter type.

The auxiliary terminal slow down speed pattern, indicated by block 131 in FIG. 1, may be generated in any suitable manner, such as by a cam in the shaft or hoistway adjacent each terminal which coacts with a cam roller on the elevator car mechanically connected to reduce the coupling between the primary and secondary windings of a transformer as the terminal floor is approached. The output of the transformer is rectified to provide the terminal slow down speed pattern.

The indication that the terminal slow down speed pattern is required is provided by a relay TSD shown in FIG. 4. Relay TSD is normally continuously energized, dropping out only when auxiliary terminal slow down is required. If the elevator car is exceeding a predetermined speed at the speed check points adjacent a terminal, which speed is higher than the speed which initiates terminal slow down, an emergency stop is initiated. The indication that an emergency stop is required is provided by a relay 29, shown in FIG. 4. Relay 29 is normally continuously energized, dropping out only when an emergency stop is required.

More specifically, relay TSD is energized through a string of closed switches or contacts which open one by one as the elevator car reaches predetermined points in the hoistway. These car position contacts are shunted by contacts of the speed indication relays shown in FIG. 2. If a speed relay drops before reaching the associated speed check point in the hoistway, the associated contact of the speed relay closes to shunt the position switch, and when the latter opens, it has no circuit effect. If a speed relay is still energized when the elevator car reaches its associated check position in the hoistway, the circuit of relay TSD will be broken, relay TSD will drop and a contact of relay TSD initiates terminal slow down. The position switches or contacts are provided for both the lower and upper terminals, with switches or contacts DS6-1 US6-1 indicating the first car position switches in the down and up directions, respectively, for an elevator system which uses six speed check points adjacent each terminal. If the speed check points are cam operated by the movement of the elevator car, the speed check points will be switches. If inductor type relays are used, then contacts of the inductor relays will be used in the circuit of FIG. 4. For purposes of example, it will be assumed that contacts of inductor relays are used.

Contacts DS6-1 and US6-1 are connected in series and this series branch is shunted by a normally closed contact S6-1 of speed relay S6. In like manner, the next car position check point in the down and up directions is provided by serially connected contacts DS5-1 and US5-1, respectively, which are shunted by contact S5-1 of relay S5. The next check point in the down and up directions is provided by serially connected contacts DS4-1 and US4-1, respectively, which are shunted by contact S4-1 of relay S4. The next check point in the down and up directions is provided by serially connected contacts DS3-1 and US3-1, which are shunted by contact S3-1 of relay S3. The next check point in the down and up directions is provided by serially connected contacts DS2-1 and US2-1, respectively, which are shunted by contact S2-1 of relay S2. The final check point in the down and up directions is provided by serially connected contacts DS1-1 and US1-1, which are shunted by contact S1-1 of relay S1. This ladder-like circuit connects relay TSD to a source of unidirectional potential, indicated by conductors L1 and L2.

Figure 5:
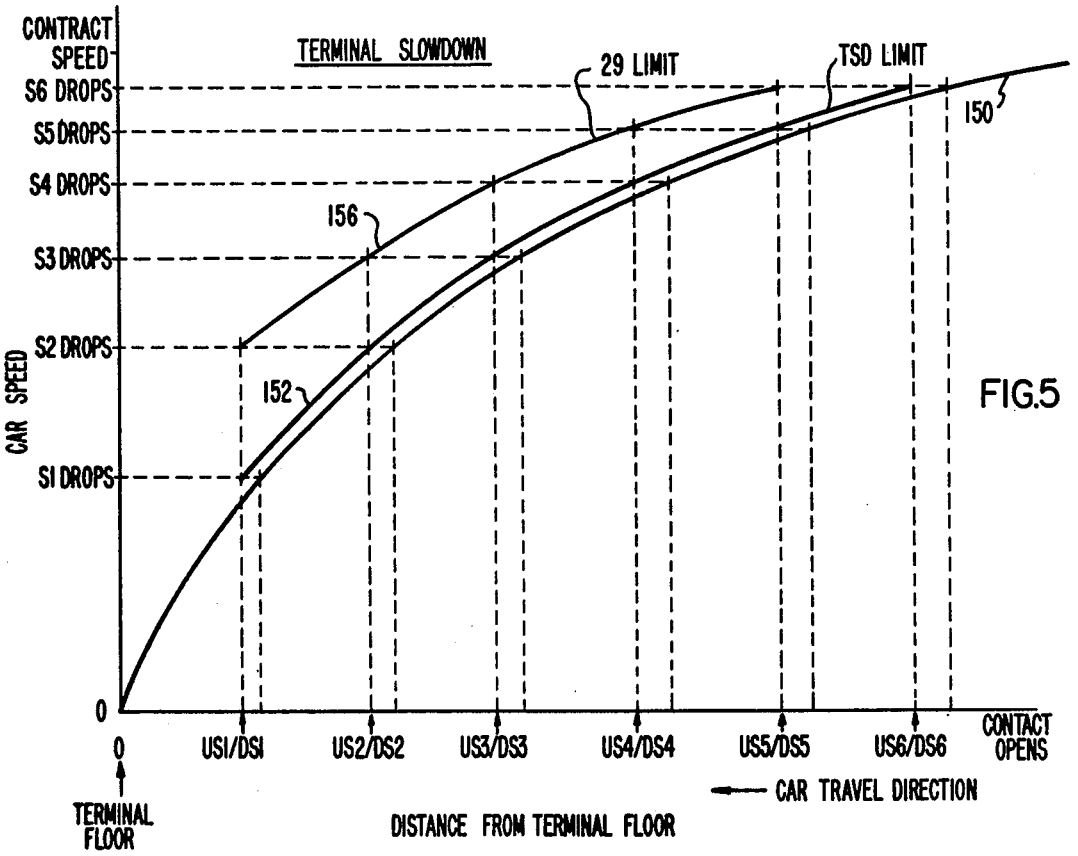
FIG. 5 is a graph which illustrates normal terminal slow down, along with the auxiliary terminal slow down and emergency stop limits applied by the detecting circuits of FIG. 4.

FIG. 2 is a graph which plots the distance from a terminal floor on the abscissa and car speed on the ordinate. The normal slow down pattern of the elevator car is indicated by curve 150. If the car is following this slow down pattern, it will be noted from FIG. 5 that relay S6 drops to close its contact S6-1 before the associated car position contact US6-1 or DS6-1 opens. Thus, relay TSD remains energized following this speed check point. The same comment applies to each speed check point as long as the slow down curve substantially follows curve 150.

The intersection formed between a vertical line from an opening point of a car position switch, with a horizontal line associated with the car speed at which its associated speed switch drops, is the point which sets the terminal slow down limit. A curve 152 is drawn between these points in FIG. 5 to illustrate how far the car speed may increase above that of curve 150 as the car approaches a terminal, before terminal slow down is initiated by the dropping of relay TSD.

The 29 relay checks a different speed relay at the various car position check points than is checked by the TSD relay circuit, with the first check point being one check point closer to the terminal than the first check point for terminal slow down, but it uses the same speed relay as the first speed check point for terminal slow down. This pattern then continues as the car reaches the other speed check points, always using a higher numbered speed relay for comparison with a specific car location than was used for terminal slow down.

More specifically, the usual safety circuits are illustrated generally at 154, and the contacts of the car position relays are connected in series with the safety circuits 154 and relay 29 between busses L1 and L2. Contacts DS5-2 and US5-2 are shunted by contact S6-2 of speed relay S6, contacts DS4-2 and US4-2 are shunted by contact S5-2, contacts DS3-2 and US3-2 are shunted by contact S4-2, contacts DS2-2 and US2-2 are shunted by contact S3-2, and contacts DS1-2 and US2-1 are shunted by contact S2-2. When the second speed check point DS5-2 or US5-2 is reached by the elevator car, the speed of the elevator car should be below the speed at which the speed relay S6 drops. If it is, contact S6-2 will already be closed when DS5-2 or US5-2 opens, and relay 29 will remain energized. If the car speed is above the value at which relay S6 drops out when the second speed check point DS5-2 or US5-2 is reached, relay 29 will be deenergized and the contact of relay 29 will initiate an emergency stop of the elevator car.

The intersection formed between a vertical line from the opening point of a car position switch with a horizontal line associated with the car speed at which its associated switch drops, is the point which sets the safety stop limit. A curve 156 is drawn between these points in FIG. 5 to illustrate how far the car speed may increase above that of curve 152 as the car approaches a terminal, before an emergency stop is initiated by the dropping of relay 29.

Figure 6:
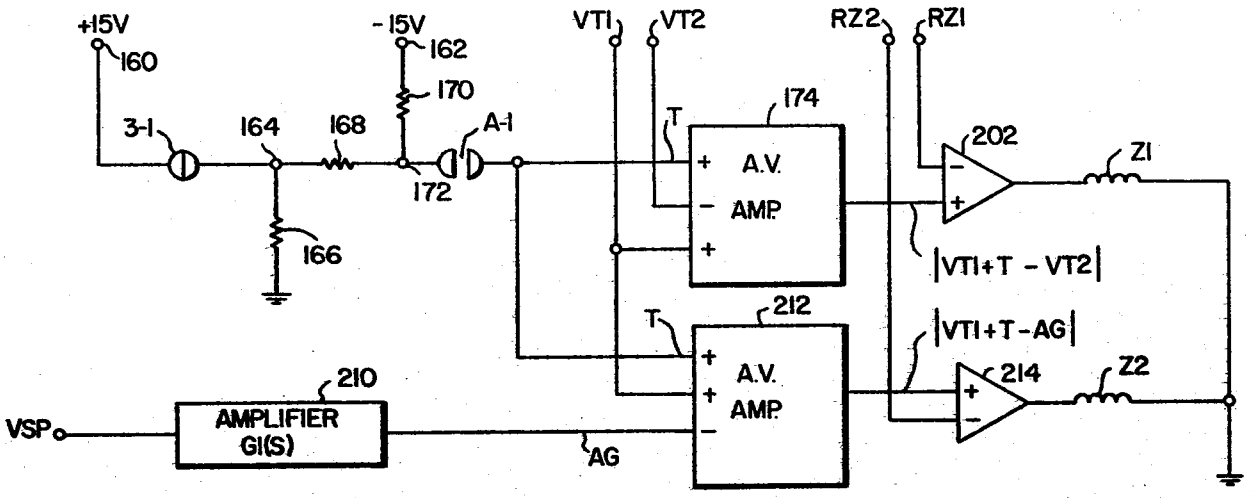
FIG. 6 is a schematic diagram of comparator circuits for comparing the outputs of the rim driven and belt driven tachometers, and for comparing the output of the rim driven tachometer with the expected dynamic response of the elevator system to the speed pattern.

The velocity signals VT1 and VT2 of tachometers 52 and 102, respectively, are continuously monitored and compared in a comparison circuit shown in FIG. 6. If a discrepancy occurs which exceeds a predetermined magnitude when the elevator car is moving, a tachometer comparison relay Z1 is energized. The discrepancy may be due to slippage of the rim driven tachometer, slippage of the hoist ropes on the drive sheave, or to a malfunctioning tachometer. The energization of relay Z1 when the car is moving results in a modification of the operation of the elevator system, as will be hereinafter explained.

Relay Z1 is checked by a test circuit, also shown in FIG. 6, to insure that relay Z1 is operational before the elevator car is allowed to start. If relay Z1 is not energized by the test signal while the elevator car is stopped, the operation of the elevator system will be modified, as will be hereinafter described.

More specifically, a test voltage of positive polarity is applied to an input terminal 160, and a test voltage of negative polarity is applied to an input terminal 162. Terminal 160 is connected to a junction 164 between a pair of resistors 166 and 168 via a normally closed contact 3-1 of running relay 3 shown in FIG. 4. Resistor 166 is selected to have a value three times that of resistor 168. The remaining side of resistor 166 is connected to ground. Terminal 162 is connected to a resistor 170, the other end of which is connected to the remaining end of resistor 168 at junction 172. Junction 172 is connected to a summing input of an absolute value amplifier 174 via a normally open contact A-1 of a brake monitor relay A shown in FIG. 4. A suitable absolute value amplifier may be constructed using two operational amplifiers, with one connected to perform as a voltage to current converter, and the other as a rectifying current-to-current converter. Diode gating diverts the current to the input of the rectifying converter which will result in a positive output voltage. The velocity signal VT1 of tachometer 52 is applied to a summing input of the absolute value amplifier 174, and the velocity signal VT2 of tachometer 102 is applied to a subtracting terminal of absolute value amplifier 174.

When the brake 39 shown in FIG. 1 is applied, contact BK-1 will close to energize relay A, and thus contact A-1 will be closed to apply a test signal T to the absolute value amplifier 174.

Figure 7:
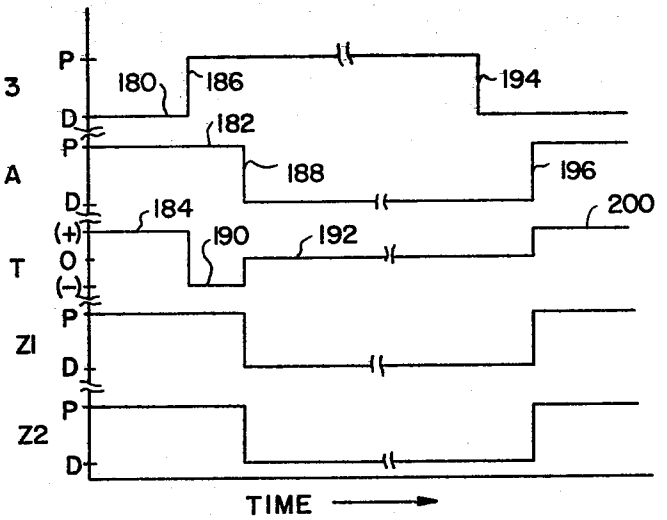
FIG. 7 is a graph which aids in understanding the comparator circuits of FIG. 6.

FIG. 7 is a graph which illustrates how negative and positive test voltages are sequentially applied to amplifier 174 before each run. When the elevator car is stopped with its brake applied, the running relay 3 will be dropped, indicated by curve portion 180, the brake monitor relay A will be picked up, indicated by curve portion 182, and a positive test voltage T, indicated by curve portion 184 will be applied to amplifier 174. When the elevator car gets ready to leave the floor, the running relay 3 picks up at 186 before the brake is released at 188, and thus during the interval between relay 3 picking up and relay A dropping, a negative test voltage T is applied to amplifier 174, as indicated by curve portion 190. When relay A drops at 188, the test voltage T goes to zero, indicated by curve portion 192. When the elevator car reaches a floor at which it is to stop, the running relay 3 drops at 194, and shortly after the running relay 3 drops, the brake is applied and relay A picks up at 196. When relay A picks up at 196 contacts 3-1 and A-1 will both be closed and the test voltage T becomes positive, indicated by curve portion 200.

The output of the absolute value amplifier 174 is applied to an input of a comparator 202, which may be an operational amplifier having inverting and non-inverting inputs. The output of absolute value amplifier 174, which is equal to the absolute value of VT1 + T − VT2, is applied to the non-inverting input of operational amplifier 202. A reference voltage RZ1 is applied to the inverting input. The reference voltage RZ1 is a positive voltage selected according to the discrepancy permitted between the tachometer signals VT1 and VT2 before relay Z1 is to be energized. Thus, when the elevator car is moving and the test voltage T is zero, if the output signals VT1 and VT2 differ by an amount less than the magnitude of reference signal RZ1, the output of comparator 202 will be negative and relay Z1, which is connected between the output of comparator 202 and ground, will be deenergized. If the discrepancy exceeds the reference magnitude RZ1, the output of comparator 202 will switch positive and relay Z1 will pick up.

When the elevator car is stopped, the positive and negative test voltages, which are selected to exceed the magnitude of RZ1, will cause comparator 202 to output a positive voltage and energize relay Z1. The monitoring of the condition of relay Z1 when the car is stopped, and also when it is moving, will be hereinafter described. FIG. 7 indicates the operation of relay Z1 when the elevator system is operating properly with "P" indicating "pick-up", and "D" indicating "dropped".

It is desirable to verify that the elevator system is performing properly, even if the tachometers 52 and 102 agree when the elevator car is running. This desirable feature is performed according to the teachings of the invention by comparing, in an absolute value amplifier 212, the velocity signal VT1 of tachometer 52, which represents the actual response of the elevator system to the speed pattern, with a signal AG which is proportional to the desired or expected response of the elevator system to the speed pattern. The signal AG may be developed by applying the speed pattern voltage VSP to an amplifier 210 which has a characteristic G1(s) which simulates the dynamic response of the elevator. The characteristic G1(s) is given by the following formula:

$$G1(s) = \frac{A}{\frac{s^2}{W_o^2} + \frac{2\rho}{W_o} S + 1}$$

a typical value for A is $\frac{1}{3}$, a typical value for $\rho$ is 0.5, and a typical value for $W_o$ is 4.

The test signal T, hereinbefore described, is applied to a summing input of absolute value amplifier 212, signal VT1 is applied to a summing input thereof, and signal AG is applied to a subtracting input thereof. The output of the absolute value amplifier 212, which is equal to the absolute value of VT1 + T − AG, is applied to the non-inverting input of a comparator 214, and a positive reference voltage RZ2 is applied to the inverting input. The output of comparator 214 is connected to one side of a relay Z2, which has its other side connected to ground. If, while the elevator car is moving, the difference between its actual response indicated by velocity signal VT1 and the desired response indicated by signal AG is less than the reference voltage RZ2, relay Z2 will not be energized. If the discrepancy exceeds the reference magnitude, relay Z2 will be energized. When the elevator car is stopped, relay Z2 will be energized if the test circuitry and relay Z2 are operative. FIG. 7 illustrates the operation of relay Z2 when the elevator system is operating properly. By comparing the actual with the desired performance of the elevator system, a malfunction can be detected before car speeds are reached which would trip the governor.

Figure 8:
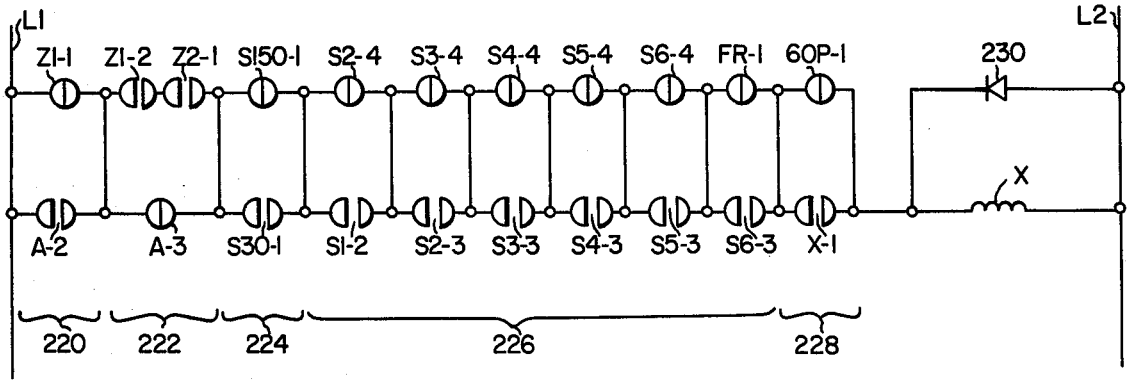
FIG. 8 is a schematic diagram illustrating a detector circuit for monitoring the various signals developed according to the teachings of the invention, which detector circuit initiates modification of the elevator system when a malfunction is detected.

FIG. 8 is a schematic diagram of a circuit which utilizes the car speed points generated by relays S1 through S(N) of FIG. 2 and the relays Z1 and Z2 of FIG. 6 in a continuous self-checking arrangement which maintains a system monitoring relay X energized if the elevator system is operating properly, and which causes relay X to be deenergized when all of the circuits are not operating properly. The circuitry for maintaining relay X in an energized condition, or for dropping it out, will be described in sections, with the sections each having a reference numeral.

Section 220 of the circuit shown in FIG. 8 determines if the tachometers 52 and 102 agree when the brake is lifted. If the tachometers agree, contact Z1-1 of relay Z1 will be closed and the brake monitor relay A will be dropped out and its contact A-2 will be open. When the brake is applied contact A-2 will close to discontinue this test. If the tachometers do not agree when the brake is lifted, contacts A-2 and Z1-1 will both be open and relay X will drop out. A diode 230 is connected across relay X to delay its drop out for a short time in order to eliminate race conditions between compared relays which operate at the same time.

Section 222 determines if the circuits for relays Z1 and Z2 are functional while the elevator car is stopped with its brake applied. It will be remembered that relays Z1 and Z2 are forced to operate when the elevator car is stopped by the test signal T. When the brake is applied, contact A-3 of the brake monitor relay A will be open, and if the relays Z1 and Z2 are functional they will both be energized and their contacts Z1-2 and Z2-1 will be closed to maintain energization of relay X.

Section 224 checks that the S150 relay is not energized before the S30 relay is energized, or that the S30 relay is not deenergized before the S150 relay is deenergized, which would indicate a failure of one of the speed check points. Section 224 includes a normally open contact S30-1 of relay S30 and a normally closed contact S150-1 of relay S150. When relay S30 picks up when the car speed reaches 30 fpm it closes its contact S30-1 and maintains energization of relay X when relay S150 picks up at 150 fpm and opens its contact S150-1. If relay S150 operates before relay S30, contact S150-1 will open to drop relay X. When the car speed drops below 150 fpm, contact S150-1 closes to maintain energization of relay X when the car speed drops below 30 fpm and contact S30-1 of relay S30 opens. If relay S30 were to drop before relay S150 drops, contact S30-1 would open to drop relay X.

Section 226 checks that all of the additional speed point relays S1 through S(N) are energized and deenergized in the correct sequence. It also checks that the highest speed point relay, which will be assumed to be indicated by relay S6, picks up before the car reaches contract speed. When full speed is approached, relay FR shown in FIG. 1 picks up and opens its contact FR-1, and if relay S6 has not picked up to close its contact S6-3, relay X will drop.

Section 228 provides an initial start-up sequence. Relay 60P (not shown) is deenergized momentarily during start-up to close contact 60P-1 and energize relay X. Relay X then seals in around contact 60P-1 via its contact X-1.

The portion of FIG. 4 which was not described earlier illustrates how the operation of the elevator system 10 may be modified by a circuit malfunction indicated by the dropping of relay X. For purposes of example, a portion of the control circuitry of U.S. Pat. No. 3,741,348, which is assigned to the same assignee as the present application, is modified and illustrated in FIG. 4. For a complete detailed description of an elevator system which utilizes this circuitry, U.S. Pat. No. 3,741,348 may be referred to.

More specifically, an up direction relay 1 is connected to be energized through the safety circuits 154, through the upper travel limit switch UL, through the direction circuits 232, which are shown in detail in U.S. Pat. No. 3,741,348, and through the M or N outputs of the direction circuits 232. The N output which is only used during leveling is connected directly to bus L2. The M output is connected to bus L2 through the serially connected contacts 55-1 of an overspeed relay 55, and SS-1 of a stepping switch SS, or through the circuit which includes make contact 3-2 of the running relay 3. The overspeed relay 55 is energized through an overspeed switch OS, which opens at a predetermined percent of overspeed, such as 10%. Relay 55 has a contact 55-2 in the solenoid circuit of the pattern generator 50, in addition to contact 55-1 in the circuit of relays 1, 2 and 3. Relay X has a normally open contact X-1 in the circuit of the overspeed relay. When relay X and the overspeed relay 55 are energized, relay 1 may be energized which picks up the running relay 3 via contact 1-4. Contact 3-2 then closes to hold relays 1 and 3 energized despite the opening of contact SS-1 or 55-1. Thus, if relay X in FIG. 8 drops due to a malfunction in one of the monitored circuits and the associated elevator car is not running, contact 55-1 will be open and the elevator car cannot be started. If the detected fault subsequently disappears, relay X will again pick up to allow the car to start. The stepping switch SS is responsive to relay X via a normally closed contact X-2. When relay X drops and closes its contact X-2 the stepping switch SS is advanced one step, and a timer 240 is started which always runs to completion of its preset cycle once started. If the fault disappears, contact X-2 will open, and if a malfunction is again detected and relay X drops out before timer 240 times out, the stepping switch SS will advance to the second step which causes contact SS-1 to open and latch in the open position until the stepping switch is manually reset. Contact SS-2 prevents the timer from resetting the stepping switch. Thus, two malfunctions within a predetermined time interval prevents the elevator car from being started via the open contact SS-1, notwithstanding the disappearance of the malfunction after the second occurrence. If a second malfunction does not occur within the predetermined time interval, timer 240 resets the stepping switch SS when it times out.

In like manner, a down direction relay 2 is initially energized through the safety circuits 154, through the down limit switch DL, through the direction circuits 232 and through contact 3-2, or through the serially connected contacts 55-1 and SS-1.

A pattern selector relay W is energized through contact 29-1 when the running relay 3 is energized via contact 3-4, and it remains energized until the brake is applied, indicated by contact A-5 of the brake monitor relay A opening. Relay W has a make contact W-1 connected in the circuit of the pattern generator 50.

The pattern generator 50, which, as hereinbefore stated, is shown in detail in U.S. Pat. No. 3,554,325, energizes solenoids which lift pawls clear of the floor stops located in the pattern generator. The stop relay breaks this circuit when energized to stop the car. The overspeed relay 55 has a contact 55-2 which opens when relay 55 drops out to drop the pawls and thus stop the car at the closest landing at which the car can make a normal stop. The maximum car speed is also reduced. The system monitoring relay X, when deenergized, thus drops the 55 relay, which opens its contact 55-2 to drop the pawls in the pattern generator 50, reduce the car speed, and stop the car at the closest landing at which the car can make a normal stop.

Contact W-1 of the pattern selector relay is connected to the pattern generator 50 in the circuit which normally opens when the floor stop of the pattern generator is captured by a dropped pawl. If the safety relay 29 is de-energized, relay W drops to open contact W-1 which simulates the capturing of a floor stop by a pawl, stopping the car without regard to its location relative to a landing.

In summary, there has been disclosed a new and improved elevator system which provides a high quality velocity feedback signal from a tachometer, enabling a system stabilizing signal to be obtained by differentiating the velocity signal provided by the tachometer. This arrangement for obtaining the stabilizing signal does not require a direct metallic contact to the armature circuit of the drive motor, and thus may be utilized even when a solid state power supply is used for the elevator drive motor. Further, the new and improved elevator system provides very accurate, easy to set speed check points, which have very little hysteresis between the speeds at which the associated relays pick up as the elevator car accelerates, and the speeds at which the relays drop out as the elevator car decelerates. The elevator system further compares the elevator dynamic performance with a generated reference, to provide an indication of a malfunction before the governor tripping speed is reached. The high quality tachometer is checked by a belt driven tachometer responsive to actual car speed, while the high quality tachometer provides a signal responsive to the motor speed. Comparison of the outputs of the tachometers detects any slippage of the friction driven high quality tachometer, any slippage between the hoist ropes and the drive sheave, and it also detects malfunctioning tachometers. Still further, all of the above functions are performed in a self-checking, fail-safe manner.

We claim as our invention:

1. An elevator system, comprising:

a structure, an elevator car mounted for movement in said structure, motive means including motor means for effecting movement of said elevator car, control means for operating said motive means, including means providing a speed pattern signal having a magnitude responsive to the desired speed of the elevator car, means providing a first speed signal having a magnitude responsive to said motor means, means responsive to said speed pattern signal for providing a response signal indicative of the expected response of the elevator car to the speed pattern signal, comparator means comparing said first speed signal and said response signal, said comparator means providing a predetermined output signal when the compared signals differ by a predetermined magnitude, and modifying means for modifying the operation of the elevator car in response to the comparator means providing said predetermined output signal when the elevator car is moving.

2. The elevator system of claim 1 including test means for modifying at least one of the compared signals when the elevator car is stopped such that the compared signals differ by at least the predetermined magnitude which causes the comparator means to provide the predetermined output signal, and wherein the modifying means modifies the operation of the elevator car when the comparator means does not provide the predetermined signal when the elevator car is stopped.

3. The elevator system of claim 2 wherein the test means modifies the at least one compared signal such that one of the compared signals is higher and then lower than the other compared signal, by at least the predetermined difference magnitude which causes the comparator means to provide the predetermined output signal.

4. The elevator system of claim 1 including means for scaling the first speed signal, first reference means providing a first reference signal indicative of a predetermined speed relative to the scaled first speed signal, means comparing the scaled first speed signal with the first reference signal, and first speed indicating means operable from a first to a second condition when the scaled first speed signal exceeds the first reference signal.

5. The elevator system of claim 4 including second reference means providing a second reference signal indicative of a predetermined speed relative to the first speed signal which is higher than the predetermined speed indicative of the first reference signal, means comparing the scaled first speed signal with the second reference signal and second speed indicating means operable from a first to a second condition when the scaled first speed means exceeds the second reference signal.

6. The elevator system of claim 5 including monitoring means for monitoring the first and second speed indicating means and providing a predetermined signal when they are not operated between their first and second conditions in the correct sequence, and wherein the modifying means modifies the operation of the elevator car when the monitoring means provides said predetermined signal.

7. The elevator system of claim 1 including means for scaling the first speed signal, reference means providing a plurality of reference signals indicative of different speeds relative to the scaled first speed signal, a plurality of comparator means comparing the scaled first speed signal with each of the plurality of reference signals, and a plurality of speed indicating means each operable from a first to a second condition when a predetermined different reference signal is exceeded by the scaled first signal.

8. The elevator system of claim 7 including monitoring means for monitoring the plurality of speed indicating means and providing a predetermined signal when they are not operated between their first and second conditions in the correct sequence, and wherein the modifying means modifies the operation of the elevator car when the monitoring means provides said predetermined signal.

9. The elevator system of claim 7 including means for providing car position signals at predetermined points as the elevator car approaches at least one of the travel limits in the structure, and including first sequence comparator means comparing each car position signal with a selected speed indicating means, and providing a predetermined first signal when the selected speed indicating means is not in its second condition when the associated car position signal is provided, and means providing an auxiliary speed pattern signal for the motive means when the first predetermined signal is provided by said first sequence comparator means.

10. The elevator system of claim 9 including second sequence comparator means comparing each car position signal with a selected speed indicating means and providing a predetermined second signal when the selected speed indicating means is in its second condition when the associated car position signal is provided, and wherein the modifying means modifies the operation of the elevator car when the second predetermined signal is provided.

11. The elevator system of claim 10 including means for preventing the starting of the elevator car when the predetermined second signal is provided a predetermined number of times within a predetermined period of time.

12. An elevator system, comprising:

a structure, an elevator car mounted for movement in said structure, motive means including motor means for effecting movement of said elevator car, first speed indicating means providing a first speed signal having a magnitude responsive to said motor means, second speed indicating means providing a second speed signal having a magnitude responsive to the movement of said elevator car, first comparator means comparing said first and second speed signals and providing a first output signal when the compared signals differ by a predetermined magnitude, and modifying means for modifying the operation of said elevator car in response to the first comparator means providing said first output signal when the elevator car is moving.

13. The elevator system of claim 12 wherein the first and second speed indicating means each includes a tachometer.

14. The elevator systen of claim 12 wherein the first speed indicating means is a friction driven tachometer, and the second speed indicating means is a belt driven tachometer.

15. The elevator system of claim 12 wherein the first speed indicating means is a rim driven tachometer, and the second speed indicating means is a belt driven tachometer, with the first tachometer having a lower percent ripple in its output signal than the second tachometer.

16. The elevator system of claim 12 including test means for modifying at least one of the compared first and second speed signals when the elevator car is stopped such that the compared signals differ by at least the predetermined magnitude which causes the first comparator means to provide the first output signal, and wherein the modifying means modifies the operation of the elevator car when the comparator means fails to provide the first signal when the elevator car is stopped.

17. The elevator system of claim 16 wherein the test means modifies the at least one compared signal such that one of the compared signals is higher and then lower than the other compared signal, by at least the predetermined difference magnitude which causes the first comparator means to provide the first output signal.

18. The elevator system of claim 16 wherein the test means modifies the at least one compared signal such that one of the compared signals is higher and then lower than the other compared signal between the stopping and restarting of the elevator car.

19. The elevator system of claim 12 including control means for operating the motive means, means providing a speed pattern signal having a magnitude responsive to the desired speed of the elevator car, means responsive to the speed pattern signal for providing a response signal indicative of the expected response of the elevator car to the speed pattern signal, second comparator means comparing the first speed signal and said response signal, said second comparator means providing a second output signal when the compared signals differ by a predetermined magnitude, and wherein the modifying means modifies the operation of the elevator car in response to the second comparator means providing said second output signal.

20. The elevator system of claim 19 including test means for modifying at least one of the compared signals associated with the first comparator means, and for modifying at least one of the compared signals associated with the second comparator means when the elevator car is stopped, such that the first and second comparator means should provide the first and second output signals, respectively, and wherein the modifying means modifies the operation of the elevator car when either of the first and second comparator means fails to provide the first and second output signals, respectively, when the elevator car is stopped.

21. The elevator system of claim 20 wherein the test means modifies the at least one compared signal of each of the first and second comparator means such that one of the compared signals is higher and then lower than the other associated compared signal by at least the predetermined difference magnitude which causes the first and second comparator means to provide the first and second output signals, respectively.

22. The elevator system of claim 21 wherein the test means modifies the at least one compared signal of each of the first and second comparator means between the stopping and restarting of the elevator car.

23. The elevator system of claim 12 including means for scaling the first and second speed signals to provide a scaled first speed signal and a scaled second speed signal, respectively, first and second reference means providing first and second reference signals indicative of predetermined different speeds relative to the scaled first speed signal and the scaled second speed signal, respectively, means comparing the scaled first speed signal with the first reference signal, first speed indicating means operable from a first to a second condition when the scaled first speed signal exceeds the first reference signal, means comparing the scaled second speed signal with the second reference signal, and second speed indicating means operable from a first to a second condition when the scaled second speed signal exceeds the second reference signal.

24. The elevator system of claim 23 including monitoring means for monitoring the first and second speed indicating means and providing a predetermined signal when they are not operated between their first and second conditions in the correct sequence, and wherein the modifying means modifies the operation of the elevator car when the monitoring means provides said predetermined signal.

25. The elevator system of claim 12 including means for scaling the first and second speed signals, reference means providing a plurality of reference signals indicative of different speeds, a plurality of comparator means comparing the scaled first and second speed signals with certain of the plurality of reference signals, and a plurality of speed indicating means each operable from a first to a second condition when a predetermined different reference signal is exceeded by the scaled first signal.

26. The elevator system of claim 25 wherein the reference signals are compared with the scaled first and second speed signals such that the scaled first and second speed signals are alternately selected for comparison as the speed of the elevator car changes.

27. The elevator system of claim 25 including monitoring means for monitoring the plurality of speed indicating means and providing a predetermined signal when they are not operated between their first and second conditions in the correct sequence, and wherein the modifying means modifies the operation of the elevator car when the monitoring means provides the predetermined signal.

28. The elevator system of claim 25 including means for providing car position signals at predetermined points as the elevator car approaches at least one of the travel limits in the structure, and including first sequence comparator means comparing each car position signal with a selected speed indicating means, and providing a predetermined first signal when the selected speed indicating means is in its second condition when the associated car position signal is provided, and means providing an auxiliary speed pattern signal for the motive means when the predetermined first signal is provided by said first sequence means.

29. The elevator system of claim 28 including second sequence comparator means comparing each car position signal with a selected speed indicating means and providing a predetermined second signal when the selected speed indicating means is in its second condition when the associated car position signal is provided, and wherein the modifying means modifies the operation of the elevator car when the predetermined second signal is provided.

30. The elevator system of claim 29 including means preventing the starting of the elevator car when the predetermined second signal is provided a predetermined number of times within a predetermined period of time.

31. An elevator system, comprising:

a structure, an elevator car mounted for movement in said structure, motive means for effecting movement of said elevator car, control means for operating said motive means, including means providing a speed pattern signal having a magnitude responsive to the desired speed of the elevator card, means responsive to said speed pattern signal for providing a response signal indicative of the expected response of the elevator car to the speed pattern signal, means providing a first signal indicative of the actual response of the elevator car to the speed pattern signal, comparator means comprising said first signal and said response signal, said comparator means providing a predetermined signal when the compared signals differ by a predetermined magnitude, and mofifying means for modifying the operation of the elevator car in response to the comparator means providing said predetermined signal.

* * * * *